US006630440B1

(12) United States Patent
Song et al.

(10) Patent No.: US 6,630,440 B1
(45) Date of Patent: Oct. 7, 2003

(54) RINSE-AID FORMULATION

(75) Inventors: Xiaoqing Song, West Chester, OH (US); Peter Robert Foley, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/762,084

(22) PCT Filed: Aug. 3, 1999

(86) PCT No.: PCT/US99/17815

§ 371 (c)(1),
(2), (4) Date: Feb. 1, 2001

(87) PCT Pub. No.: WO00/08125

PCT Pub. Date: Feb. 17, 2000

Related U.S. Application Data

(60) Provisional application No. 60/095,158, filed on Aug. 3, 1998.

(51) Int. Cl.[7] ..... C11D 1/66; C11D 1/72; C11D 3/37; C11D 3/34

(52) U.S. Cl. ..... 510/524; 510/223; 510/230; 510/421; 510/434; 510/476; 510/477; 510/488; 510/514; 510/525

(58) Field of Search ..... 510/223, 230, 510/421, 434, 476, 477, 488, 514, 524, 525

(56) References Cited

U.S. PATENT DOCUMENTS

| | | | |
|---|---|---|---|
| 3,563,901 | A | 2/1971 | Crotty |
| 3,671,440 | A | 6/1972 | Sabatelli et al. |
| 3,853,981 | A | 12/1974 | Hadzeriga |
| 3,922,230 | A | 11/1975 | Lamberti et al. |
| 3,933,673 | A | 1/1976 | Davies |
| 3,950,260 | A | 4/1976 | Eldib |
| 4,203,858 | A | 5/1980 | Chakrabarti |
| 4,443,270 | A | 4/1984 | Biard et al. |
| 4,521,332 | A | 6/1985 | Milora |
| 4,678,596 | A | 7/1987 | Dupre et al. |
| 5,516,452 | A | 5/1996 | Welch et al. |
| 5,739,099 | A | 4/1998 | Welch et al. |

FOREIGN PATENT DOCUMENTS

| | | | | |
|---|---|---|---|---|
| DE | 4316744 | | 11/1994 | |
| EP | 0 245 987 | A2 | 11/1987 | |
| EP | 0 308 221 | B1 | 3/1989 | |
| EP | 0 308 221 | A1 | 3/1989 | |
| EP | 0 659 871 | A1 | 6/1995 | |
| EP | 0659 872 | A1 | 6/1995 | |
| EP | 659872 | A1 * | 6/1995 | ..... C11D/3/36 |
| EP | 659872 | * | 6/1995 | ..... C11D/3/36 |
| EP | 0659 873 | A1 | 6/1995 | |
| EP | 0 851 021 | A2 | 7/1998 | |
| EP | 851021 | * | 7/1998 | ..... C11D/1/66 |
| GB | 2 311 537 | A | 10/1997 | |

OTHER PUBLICATIONS

BASF Product Literature for Sokalan PA 30. BASF Aktiengesellschaft, p. 1, no date given.*

BASF Product Literature for Plurafac LF 404. BASF Aktiengesellschaft, p. 1, no date given.*

* cited by examiner

*Primary Examiner*—Yogendra N. Gupta
*Assistant Examiner*—Brian P. Mruk
(74) *Attorney, Agent, or Firm*—Kevin L. Waugh

(57) ABSTRACT

A stable aqueous rinse aid dispersion includes a low foaming nonionic surfactant present in a range of from about 2% to about 80% by weight of the rinse aid dispersion, a hydrotrope present in a range of from about 0.5% to about 20% by weight of the rinse aid dispersion, and a partially neutralized poly(meth)acrylic acid polymer present in a range of from about 0.1% to about 15% by weight of the rinse aid dispersion, wherein the polymer is at least 75% non-neutralized. The poly(meth)acrylic acid polymer has an average molecular weight in a range of from about 1000 to about 50,000. The rinse aid dispersion has a pH in a range of from about 2 to about 6. The stable aqueous rinse aid dispersion is essentially free of a high molecular weight compatibilizing polymer.

17 Claims, No Drawings

RINSE-AID FORMULATION

This application claims the priority of Provisional application No. 60/095,158, filed Aug. 3, 1998.

TECHNICAL FIELD

The present invention relates to a machine dishwasher rinse aid formulation useful for promoting wetting of the rinse water as well as preventing hard water precipitation on substrates and thereby reducing spotting and filming of the dried substrate surface. More particularly, the invention relates to compatibilization of a low foaming nonionic surfactant with a low molecular weight acidic or neutralized poly(meth)acrylic acid, to foam a stable, non-phase separating aqueous rinse aid dispersion under acidic conditions, without the aid of a high molecular weight compatibilizing polymer and without requiring an additional high cloud point nonionic surfactant.

BACKGROUND OF THE INVENTION

Rinse aids are used in commercial and institutional machine dishwashers and very often, also in household automatic dishwashers. During the rinse cycle, a final rinse of fresh water serves to displace pre-final rinse water and its attendant detergent and soil residues. Rinse aid formulations are aqueous solutions containing a low foam nonionic surfactant. During the rinse cycle, the rinse aid is injected into the final fresh water rinse at a concentration of about 100 to about 500 ppm. The surfactant in the rinse water lowers the surface tension of the rinse water and improves the wetting action of the rinse water on the somewhat hydrophobic substrate surfaces. Improved wetting reduces the tendency of the rinse water to form drops containing dissolved solids on the substrate surface which give rise to spots upon drying. Accordingly, the functions of the surfactant in the rinse aid are to effectively reduce the surface tension during the draining period and to be low foaming so as to avoid traces of foam on the rinsed substrate which result in a residue upon evaporation. While low foam surfactant have improved the wetting of rinse water on substrates, they have not completely eliminated spotting and streaking problems. It is known that the addition of a low molecular weight neutralized polyelectrolyte, such as polyacrylate, to the rinse water can further reduce spotting and filming or streaking.

It is known that poly(meth)acrylic acid polymers are especially useful because they do not contribute to foam formation and do not interfere with the soil defoaming activity of the low foam surfactants. It is also known that a major obstacle to the use of low molecular weight poly (meth)acrylic acid polymers in rinse aids is the incompatibility of these polymers in aqueous rinse aid formulations containing low foam surfactants. Combining such polymers and sur ants in water results in phase separation. Upon standing for a short period of time the water containing these polymers and surfactants will form two or more layers of different compositions. This phase separation is obviously unsatisfactory since non-uniform addition of the desired components will occur as the formulation is injected into the dishwashing machine. For example, the formulation may contain too little surfactant to provide adequate wetting or too much surfactant, leading to excessive foam.

It is known to combine low molecular weight polyclectrolytes with low foam surfactants in detergent formulations. One reference discloses the desirability for combining polyelectrolytes with low foam surfactants in rinse aid concentrates. However, this reference requires the use of an alkali neutralized high molecular weight polymer to compatibilize the low foam nonionic surfactant with a low molecular weight neutralized poly(meth)acrylic acid in order to form a stable, non-phase separating aqueous rinse aid dispersion.

It is also known to formulate a stable rinse aid composition by mixing a low foam nonionic surfactant, an acrylic acid polymer of molecular weight 1000 to 250,000, and an additional nonionic surfactant having a cloud point of at least 70 degrees C, to serve as a stabilizer.

It is an object of the present invention to formulate an aqueous rinse aid containing a low foam nonionic surfactant and a low molecular weight neutralized, partially neutralized, or non-neutralized poly(meth)acrylic acid without the use of a compatibilizing high molecular weight polymer or a high cloud point co-surfactant. It is a further object of the invention to provide a stable aqueous rinse aid dispersion which reduces spotting and filming while improving sheeting action and drainage.

BACKGROUND ART

U.S. Pat. Nos. 3,563,901 and 4,443,270 disclose hydrotropes such as sodium xylene sulfonate, cumene sulfonate and short chain alkyl sulfates, used for raising the cloud point of low foam surfactants to permit the formulation of stable aqueous concentrates.

U.S. Pat. No. 4,203,858 discloses a low foaming, phosphate-free, dishwashing composition comprising an alkali metal or ammonium carbonate, such as sodium carbonate, a water soluble salt of a polyelectrolyte having a molecular weight of from about 500 and 4,000 and optionally up to 10 weight percent of a foam-suppressing nonionic surfactant. Typical of the polyelectrolytes are acrylic, methacrylic, maleic and itaconic acid polymers. Homopolymers and copolymers of acrylic and methacrylic acid having a molecular weight ranging from 504 to 1291 are preferred. The '858 patent discloses that the major differences between this composition and prior polyclectrolytes-built dishwashing compositions are the low concentration of polyelectrolyte and the poor metal ion sequestering capability of these polyelectrolytes.

Other references disclosing poly(meth)acrylic acids and their salts in detergent and cleaning applications include U.S. Pat. Nos. 3,671,440; 3,853,981; 3,950,260; 3,933,673; 3,922,230 and 4,521,332. These references do not disclose the desirability of combining polyelectrolytes with low foam surfactants in rinse aid concentrates.

U.S. Pat. No. 4,678,596 discloses the use of an alkali neutralized high molecular weight polymer to compatibilize the low foam nonionic surfactant with a low molecular weight neutralized poly(meth)acrylic acid in order to form a stable, non-phase separating aqueous rinse aid dispersion. Other related references include European Patent Nos. 245,987 and 308,221.

EPO 308221B1 discloses a rinse aid composition containing a low foam nonionic surfactant, an acrylic acid polymer of molecular weight 1000 to 250,000, and an additional nonionic surfactant having a cloud point of at least 70 degrees C, to serve as a stabilizer.

All of the above references either (I) require the use of a high molecular weight compatibilizing polymer, or (ii) require an additional nonionic surfactant having a cloud point of at least 70 degrees C, in order to provide a stable non-phase separating rinse aid.

U.S. Pat. No. 5,739,099 discloses a rinse aid composition comprising a blend of nonionic, cationic, anionic zwitterionic and amphoteric surfactants, hydrotropes, and copolymers of alkylene oxide adducts of allyl alcohol and acrylic acid useful in reducing spotting and filming of dishware.

U.S. Pat. No. 5,516,452 discloses a rinse aid composition utilizing an anionic hydrotrope and a blend of two nonionic surfactants, such as alcohol alkoxylate and a block copolymer of ethylene oxide and propylene oxide.

SUMMARY OF THE INVENTION

The invention meets the needs above by providing a stable aqueous rinse aid dispersion. In one aspect of the present invention, the rinse aid dispersion includes: (i) a low foaming nonionic surfactant present in a range of from about 2% to about 80% by weight of the rinse aid dispersion; (ii) a hydrotrope present in a range of from about 0.5% to about 20% by weight of the rinse aid dispersion; and (iii) a poly(meth)acrylic acid polymer present in a range of from about 0.1% to about 15% by weight of the rinse aid dispersion. The poly(meth)acrylic acid polymer has a weight average molecular weight in a range of from about 1000 to about 50,000. The rinse aid dispersion has a pH in a range of from about 2 to about 6.

In another aspect of the present invention, the rinse aid includes: (i) a low foaming nonionic surfactant present in a range of from about 2% to about 80% by weight of the rinse aid dispersion; (ii) a hydrotrope present in a range of from about 0.5% to about 20% by weight of the rinse aid dispersion; and (iii) a non-neutralized or only partially neutralized poly(meth)acrylic acid polymer present in a range of from about 0.1% to about 15% by weight of the rinse aid dispersion. The rinse aid dispersion has a pH in a arrange of from about 3 to about 5. The hydrotrope is selected from the group consisting of sodium cumene sulfonate, sodium xylene sulfonate, sodium toluene sulfonate, dioctyl sodium sulfosuccinate, alkyl naphthalene sulfonate and dihexyl sodium sulfosuccinate.

DETAILED DESCRIPTION OF THE INVENTION

In the preferred embodiment of the present invention, the rinse aid dispersion includes: (i) a low foaming nonionic surfactant present in a range of from about 2% to about 80% by weight of the rinse aid dispersion; (ii) a hydrotrope present in a range of from about 0.5% to about 20% by weight of the rinse aid dispersion; and (iii) a poly(meth) acrylic acid polymer present in a range of from about 0.1% to about 15% by weight of the rinse aid dispersion. The balance is water. The poly(meth)acrylic acid polymer has a weight average molecular weight in a range of from about 1000 to about 50,000. The rinse aid dispersion has a pH in a range of from about 2 to about 6.

Nonionic Surfactant

The nonionic surfactants useful in the rinse aid dispersion may be any known low foaming nonionic surfactant used in machine dishwashing applications. Typical suitable nonionic surfactants include the following commercially available materials: TRITON R™ CF-10 (an alkylaryl polyether) and TRITON DF-16™ (a modified polyalkoxylated alcohol) manufactured by Rohm and Has Company; PLURAFAC LF404™, which is a mixed linear alcohol alkoxylate; and PLURONIC R™ L-62 (a polyoxyethylene-polyoxypropylene block copolymer), both manufactured by BASF Wyandotte Corporation. The rinse aid formulation of the invention may contain one or a mixture of such low foaming nonionic surfactants.

In one embodiment of the rinse aid dispersion, the low foaming nonionic surfactant is present in a range of from about 2% to about 80% by weight of the rinse aid dispersion. In a more specific embodiment, the low foaming nonionic surfactant is present in a range of from about 5% to about 60%, and, in an even more specific embodiment, the low foaming nonionic surfactant is present in a range of from about 5% to about 20% by weight of the rinse aid dispersion.

Essentially any nonionic surfactants useful for detersive purposes can be included in the compositions. Exemplary, non-limiting classes of useful nonionic surfactants are listed below.

(i) Nonionic Polyhydroxy Fatty Acid Amide Surfactant

Polyhydroxy fatty acid amides suitable for use herein are those having the structural formula $R_2CONR_1Z$ wherein: $R_1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

(ii) Nonionic Condensates of Alkyl Phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

(iii) Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

(iv) Nonionic Ethoxylated/propoxylated Fatty Alcohol Surfactant

The ethoxylated $C_6$–$C_{18}$ fatty alcohols and $C_6$–$C_{18}$ mixed ethoxylated/propoxylated fatty alcohols are highly preferred surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

(v) Nonionic EO/PO Condensates With Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available PLURONIC™ surfactants, marketed by BASF.

(vi) Nonionic EO Condensation Products With Propylene Oxide/ethylene Diamine Adducts The condensation products of ethylene oxide with the product resulting form the reaction of propylenedioxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available TETRONIC™ compounds, marketed by BASF.

(vii) Nonionic Alkylpolysaccharide Surfactant

Suitable allylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

(viii) Nonionic Fatty Acid Amide Surfactant

Fatty acid amide surfactants suitable for use herein are those having the formula:

$$R^6-\overset{\overset{\displaystyle O}{\|}}{C}-N(R^7)_2$$

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $-(C_2H_4O)_xH$, where x is in the range of from 1 to 3.

The hydrotrope useful in the present rinse aid dispersion is selected from the group consisting of sodium cumene sulfonate, sodium xylene sulfonate, sodium toluene sulfonate, dioctyl sodium sulfosuccinate, alkyl naphthalene sulfonate and dihexyl sodium sulfosuccinate. Preferably, the hydrotrope is sodium cumene sulfonate.

In one embodiment of the rinse aid dispersion, the hydrotrope is present in a range of from about 2% to about 20% by weight of the rinse aid dispersion. In a more specific embodiment, the hydrotrope is present in a range of from about 2% to about 7% by weight of the rinse aid dispersion.

Poly(meth)acrylic Acid Polymer

The low molecular weight poly(meth)acrylic acid polymer useful in the present rinse aid dispersion is selected from the group consisting of polyacrylate homopolymer, polyacrylate copolymer, polyacrylate terpolymer, and mixtures thereof. Preferably, the poly(meth)acrylic acid polymer is a partially neutralized or non-neutralized poly(meth)acrylic acid polymer having a pH in a range of from about 3.0 to about 4.0. In the preferred embodiment, the polyacrylate copolymer is desirably at least about 75% non-neutralized. Alternatively, the polyacrylate copolymer is non-neutralized. Still alternatively, a neutralized polyacrylate copolymer which is more than 25% neutralized, may also be used but an acid must be added in an amount sufficient to bring the pH value of the resultant dispersion within a range of from about 2 to about 6.

Typically the polyacrylate homopolymer is a polymer of acrylic or methacrylic acid, or a copolymer formed from at least about 50 weight percent acrylic acid and 50 weight percent or less of a suitable copolymerizable comonomer. Suitable comonomers include lower alkyl ($C_2$–$C_4$) acrylates; methacrylic acid and lower alkyl($C_2$–$C_4$) methacrylates and amides, such as acrylamido sulfonic acids including 2-acrylamido-2 methyl propane sulfonic acid (AMPS). The poly(meth)acrylic acid is a low molecular weight polymer, or its alkali metal or ammonium salt, having an average molecular weight ranging from about 2,000 to about 40,000. In one embodiment the poly(meth)acrylic acid polymer is present in a range of from about 0.1% to about 3% by weight of the rinse aid dispersion.

The low molecular weight acrylic acid containing polymer may be either a homopolymer or a copolymer including the essential acrylic acid or acrylic acid salt monomer units. Copolymers may include essentially any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof.

Acid

When adding an acid to the rinse aid dispersion, any acid may be used although organic acids are more desirable and the preferred organic acid is citric acid.

It has been discovered that even in the absence of a compatibilizing high molecular weight polymer, but with the addition of a hydrotrope and in acidic conditions, the stable rinse aid dispersion does not phase separate upon storage for a reasonable time or under actual use conditions and permits each component to effectively reduce spotting and filming and improve sheeting action without interfering with the foaming and defoaming action of the surfactant.

In the preferred embodiment, the rinse aid formulation of the invention is an aqueous dispersion at a pH of from about 3 to about 6. Preferably, the pH ranges from about 3 to about 5.

The rinse aid dispersion of the present invention is preferably prepared by stirring the desired amount of the surfactant into an aqueous solution of the low molecular weight non-neutralized or only partially neutralized (no more than 25% neutralized) poly(meth)acrylic acid followed by the gradual addition of the hydrotrope and if necessary, citric acid to bring the dispersion to within the desired pH range.

The formulation may also contain other additives including sequestants such as NTA, EDTA, or sodium citrate and water miscible solvents such as ethanol, isopropanol and propylene glycol. Ethanol is the preferred solvent, present desirably in a range of from about 0.1% to about 10% by weight of the rinse aid dispersion and preferably in a range of from about 2% to about 8% by weight.

In an even more preferred embodiment of the present invention, the stable rinse aid dispersion includes: (i) a low foaming nonionic surfactant present in a range of from about 2% to about 80% by weight of the rinse aid dispersion; (ii) a hydrotrope present in a range of from about 0.5% to about 20% by weight of the rinse aid dispersion; and (iii) a non-neutralized poly(meth)acrylic acid polymer present in a range of from about 0.1% to about 15% by weight of the rinse aid dispersion. The rinse aid dispersion has a pH in a range of from about 3 to about 4. The hydrotrope is selected from the group consisting of sodium cumene sulfonate, sodium xylene sulfonate, sodium toluene sulfonate, dioctyl sodium sulfosuccinate, alkyl naphthalene sulfonate and dihexyl sodium sulfosuccinate. Preferably, the hydrotrope is sodium cumene sulfonate, the partially-neutralized poly (meth)acrylic acid polymer is a polyacrylate copolymer which is about 20% neutralized. In the preferred embodiment, the stable aqueous rinse aid dispersion is essentially free from a high molecular weight compatibilizing polymer and is also free of an additional nonionic surfactant having a cloud point of at least 70 degrees C.

The following examples are intended to illustrate the invention.

EXAMPLE 1

A rinse aid dispersion according to the present invention was made as follows, from the following composition, by weight percent:

| | |
|---|---|
| Low foam nonionic surfactant | 20.0% |
| Sodium cumene sulfonate hydrotrope | 7.0% |
| Polyacrylate copolymer (20% neutralized) | 4.5% |
| Ethanol | 6.0% |
| Water | 62.5% |

EXAMPLE 2

Another rinse aid dispersion according to the present invention was made as follows, from the following composition, by weight percent:

| | |
|---|---|
| Low foam nonionic surfactant | 15.0% |
| Sodium cumene sulfonate hydrotrope | 7.0% |
| Polyacrylate copolymer (20% neutralized) | 5.0% |
| Citric acid | 2.5% |
| Ethanol | 6.0% |
| Water | 64.5% |

EXAMPLE 3

In another example, a rinse aid dispersion of the present invention was prepared by the following procedure: 15.0 grams of a low foaming nonionic surfactant (Plurafac LF 404™), 15.0 grams of a 45% active sodium cumene sulfonate hydrotrope (45% active SCS), 10.0 grams of a 50% active polyacrylate copolymer (Acusol 480™, made by Rohm & Haas), 5.0 grams of a 50% active citric acid, 6.0 grams of ethanol and 49.0 grams of deionized water were added to a beaker and stirred sequentially. The resulting mixture obtained was a clear, single-phase dispersion and was found to be stable, with no phase separation occurring after the resulting mixture was kept undisturbed in a closed container for a period of 2 weeks at a temperature of 50 degrees C.

Accordingly, having thus described the invention in detail, it will be obvious to those skilled in the art that various changes may be made without departing from the scope of the invention and the invention is not to be considered limited to what is described in the specification.

What is claimed is:

1. A stable aqueous rinse aid dispersion, comprising:

a low foaming nonionic surfactant present in a range of from 2% to 80% by weight of said rinse aid dispersion;

a hydrotrope present in a range of from 0.5% to 20% by weight of said rinse aid dispersion; and a partially-neutralized poly(meth)acrylic acid polymer present in a range of from 0.1% to 15% by weight of said rinse aid dispersion, said polymer having an average molecular weight in a range of from 1000 to 50,000, wherein said partially-neutralized poly(meth) acrylic acid polymer is at least 75% non-neutralized and said rinse aid dispersion exhibits a pH in a range of from 2 to 6; and at least one of either an acid or ethanol.

2. The stable aqueous rinse aid dispersion of claim 1, wherein the acid is present in a range of from about 0.1% to about 20% by weight of said rinse aid dispersion.

3. The stable aqueous rinse aid dispersion of claim 2, wherein said acid is present in a range of from about 0.1% to about 2.5% by weight of said rinse aid dispersion.

4. The stable aqueous rinse aid dispersion of claim 2, wherein said acid is citric acid.

5. The stable aqueous rinse aid dispersion of claim 1, wherein the ethanol is present in a range of from about 0.1% to about 10% by weight of said rinse aid dispersion.

6. The stable aqueous rinse aid dispersion of claim 5, wherein said ethanol is present in a range of from about 2% to about 8% by weight of said rinse aid dispersion.

7. The stable aqueous rinse aid dispersion of claim 1, wherein said low foaming nonionic surfactant is selected from the group consisting of nonionic ethoxylated alcohols, nonionic ethoxylated fatty alcohols, nonionic propoxylated fatty alcohols, nonionic ethoxylated alcohol condensates with propylene glycol, nonionic propoxylated alcohol condensates with propylene glycol, and mixtures thereof.

8. The stable aqueous rinse aid dispersion of claim 1, wherein said hydrotrope is selected from the group consisting of sodium cumene sulfonate, sodium xylene sulfonate, sodium toluene sulfonate, dioctyl sodium sulfosuccinate, alkyl naphthalene sulfonate and dihexyl sodium sulfosuccinate.

9. The stable aqueous rinse aid dispersion of claim 1, wherein said hydrotrope is sodium cumene sulfonate.

10. The stable aqueous rinse aid dispersion of claim 1, wherein said poly(meth)acrylic acid polymer is selected from the group consisting of polyacrylate homopolymer, polyacrylate copolymer, polyacrylate terpolymer, and mixtures thereof.

11. The stable aqueous rinse aid dispersion of claim 1 having a pH in a range of from about 3.0 to about 4.0.

12. The stable aqueous rinse aid dispersion of claim 1, wherein said low foaming nonionic surfactant is present in a range of from about 5% to about 20% by weight of said rinse aid dispersion.

13. The stable aqueous rinse aid dispersion of claim 1, wherein said hydrotrope is present in a range of from about 2% to about 7% by weight of said rinse aid dispersion.

14. The stable aqueous rinse aid dispersion of claim 1, wherein said poly(meth)acrylic acid polymer is present in a range of from about 0.1% to about 5% by weight of said rinse aid dispersion.

15. The stable aqueous rinse aid dispersion of claim 1, wherein said rinse aid dispersion has a pH in a range of from about 3 to about 5.

16. The stable aqueous rinse aid dispersion of claim 1, wherein said stable aqueous rinse aid dispersion is essentially free of one or more of a high molecular weight compatibilizing polymer and a compatibilizing nonionic surfactant having a cloud point of at least 70 degrees C.

17. A stable aqueous rinse aid dispersion, comprising:

a low foaming nonionic surfactant present in a range of from about 5% to about 60% by weight of said rinse aid dispersion;

a hydrotrope present in a range of from about 2% to about 20% by weight of said rinse aid dispersion, said hydrotrope being selected from the group consisting of sodium cumene sulfonate, sodium xylene sulfonate, sodium toluene sulfonate, dioctyl sodium sulfosuccinate, alkyl naphthalene sulfonate and dihexyl sodium sulfosuccinate; and a partially-neutralized poly(meth)acrylic acid polymer present in a range of from about 0.1% to about 15% by weight of said rinse aid dispersion; said rinse aid dispersion having a pH in a range of from about 3 to about 5, wherein said partially-neutralized poly(meth) acrylic acid polymer is at least 75% non-neutralized; and at least one of either an acid or ethanol.

* * * * *